US005133455A

United States Patent [19]

Chow

[11] Patent Number: 5,133,455

[45] Date of Patent: Jul. 28, 1992

[54] TOOL BOX

[76] Inventor: Jessie Chow, No. 15-30, Kuangming Rd., Hsitwen Dist., Taichung, Taiwan

[21] Appl. No.: 745,264

[22] Filed: Aug. 14, 1991

[51] Int. Cl.[5] ..... B65D 25/06

[52] U.S. Cl. ..... 206/374; 206/373; 206/378; 206/806; 220/337

[58] Field of Search ..... 206/372-379, 206/558, 564, 806; 220/337, 338, 326

[56] References Cited

U.S. PATENT DOCUMENTS

| | | | |
|---|---|---|---|
| 2,733,830 | 2/1956 | Ruskin | 220/338 |
| 3,302,917 | 2/1967 | Winkler | 206/806 |
| 4,285,556 | 8/1981 | Loeffel | 206/372 |
| 4,349,102 | 9/1982 | Strongwater | 206/806 |
| 4,591,056 | 5/1986 | Groch | 206/564 |
| 4,714,158 | 12/1987 | Oltman et al. | 206/378 |
| 4,768,651 | 9/1988 | Lanius | 206/373 |
| 4,884,689 | 12/1989 | Su-Chin | 206/372 |
| 4,901,882 | 2/1990 | Gonclaves | 220/326 |
| 5,071,004 | 12/1991 | Rivera | 206/378 |

FOREIGN PATENT DOCUMENTS

| | | | |
|---|---|---|---|
| 2228920 | 9/1990 | United Kingdom | 206/372 |

*Primary Examiner*—Jimmy G. Foster
*Attorney, Agent, or Firm*—Biebel & French

[57] ABSTRACT

A tool box including a housing having a cavity for receiving a wrench and having a chamber for receiving a casing, a cover having one end pivotally coupled to the housing and having a protrusion formed on the free end, an engaging plate formed in the outer end of the housing and engageable with the protrusion of the cover so that the cover can be closed, the casing having a number of holes for receiving a number of tools and having a handle portion so that the casing can be easily pulled away from the chamber of the housing.

1 Claim, 4 Drawing Sheets

TOOL BOX

BACKGROUND OF THE INVENTION

1. Field of the Invention

The present invention relates to a box, and more particularly to a tool box.

2. Description of the Prior Art

The closest prior art of which applicant is aware is his prior U.S. patent application Ser. No. 07/615,887, filed Nov. 20, 1990, entitled "A TOOL BOX HAVING A RETAINING DEVICE", allowed Feb. 7, 1991 now U.S. Pat. No. 5,036,975.

The present invention has arisen to provide a novel tool box.

SUMMARY OF THE INVENTION

The primary objective of the present invention is to provide a tool box in which a number sets of tools can be changeably disposed in the tool box.

In accordance with one aspect of the invention, there is provided a tool box including a housing having a cavity formed therein for receiving a wrench and having a chamber formed therein for receiving a casing, a cover having one end pivotally coupled to a first end of the housing and having a first engaging means formed on the free end thereof, a second engaging means formed in a second end of the housing and engageable with the first engaging means of the cover so that the cover can be closed, the casing having a number of holes formed therein for receiving a number of tools and having a handle portion formed thereon so that the casing can be easily disengaged from the chamber of the housing.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
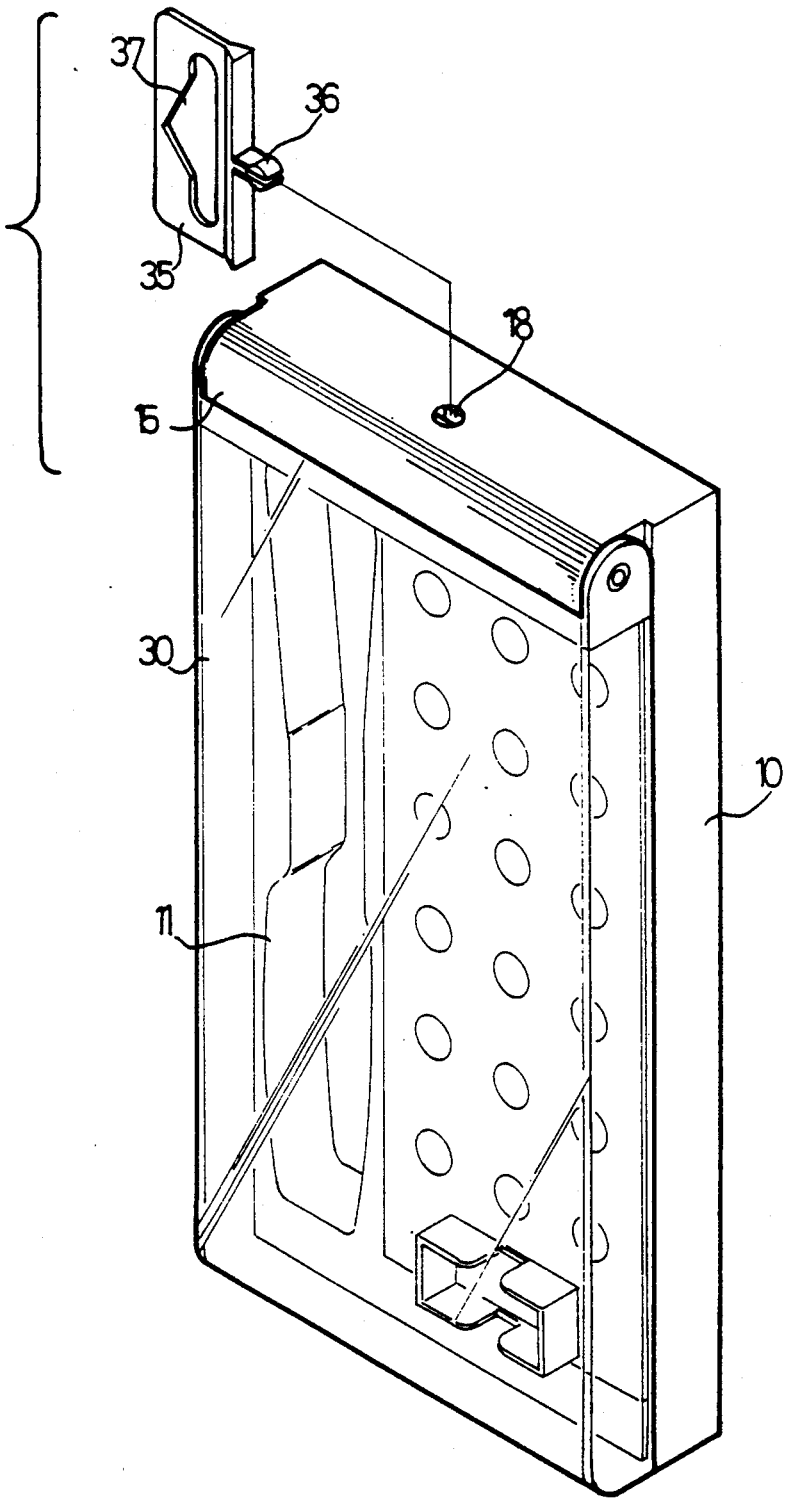
FIG. 1 is a perspective view of a tool box in accordance with the present invention.
Figure 2:
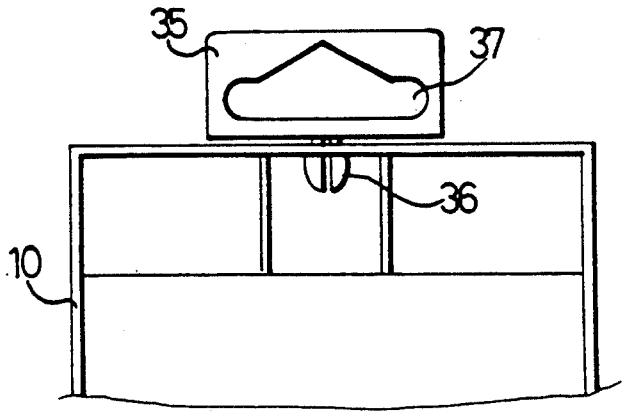
FIG. 2 is a plane view illustrating the upper portion of the rear portion of the tool box.
Figure 3:
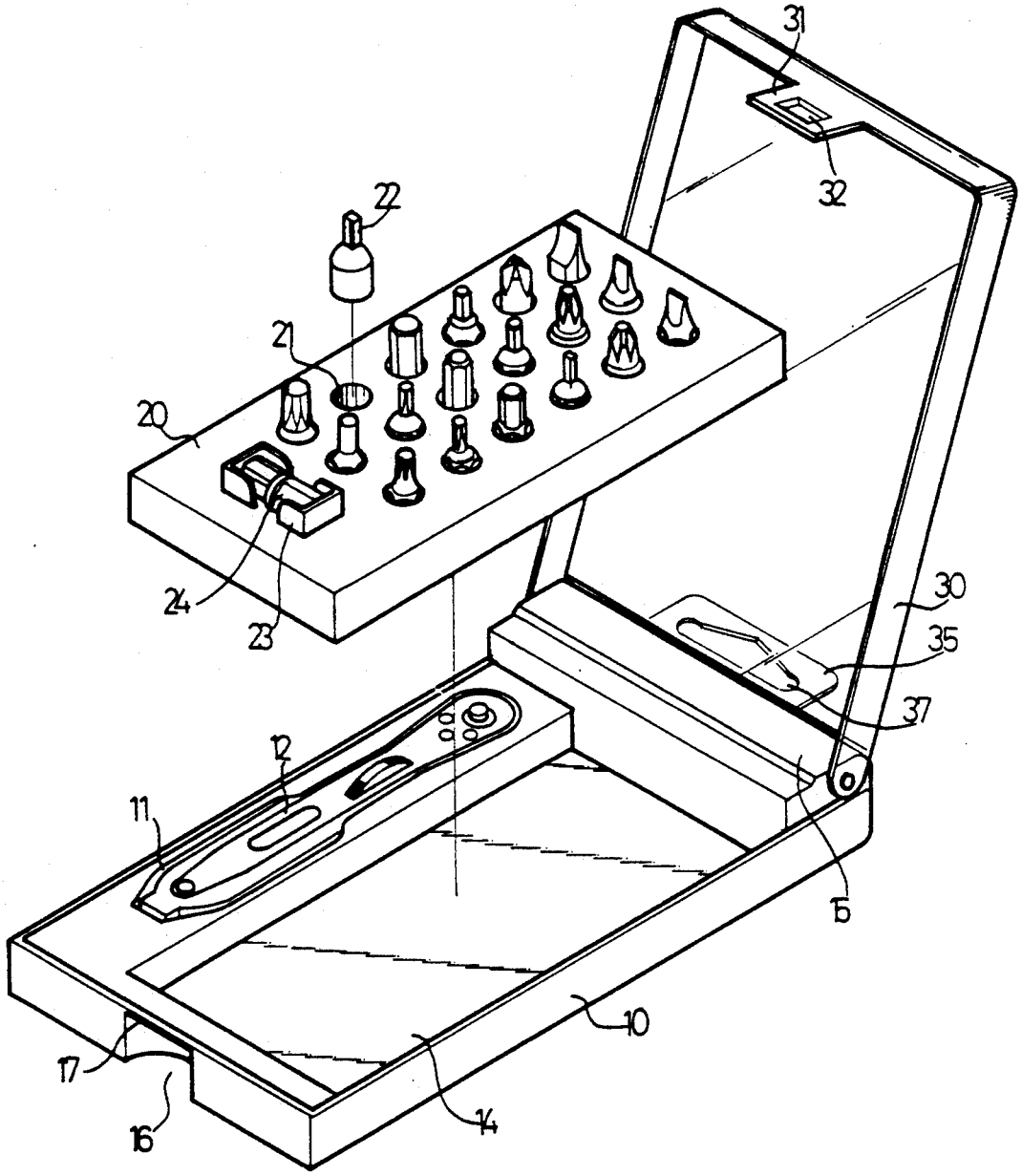
FIGS. 3 and 4 are exploded view of the tool box.

Referring to the drawings and initially to FIGS. 1, 2 and 3, a tool box in accordance with the present invention comprises generally a housing 10 having a cavity 11 formed therein foı receiving a wrench 12 and having a chamber 14 formed therein for receiving a casing 20; and a cover 30 having a first end pivotally coupled to a bulge 15 which is formed on a first end of the housing 10.

The cover 30 is preferably made of transparent materials and has a flap 31 formed integral on the second end thereof. A protrusion 32 is formed on the flap 31 and projects toward the first end of the cover 30. A recess 16 is formed in the second end of the housing 10 and an engaging plate 17 is formed above the recess 16. The protrusion 32 of the cover 30 is engageable with the engaging plate 17 of the housing 10 so that the cover 30 can be maintained in a closed position.

As shown in FIGS. 1 and 2, an aperture 18 is formed in the first end of the housing. An ear 35 includes a pair of prongs 36 engageable within the aperture 18 of the housing 10 so that the ear 35 can be attached to the housing 10; and an opening 37 formed therein so that the tool box in accordance with the present invention can be hung on a display stand or the like. The ear 35 can be detached and can be disposed within the housing 10 so that the volume of the tool box can be reduced. This is good for transportation purposes.

The casing 20 includes a plurality of holes 21 formed therein for receiving a plurality of tools 22, particularly a set of tools, which are engageable with the wrench 12. A pair of U-shaped wall members 23 are oppositely formed on the casing 20 for receiving a coupler 24 which, for example, is coupled between the wrench 12 and either of the tools 22. The wall members 23 project upward from the casing 20 and act as a handle portion so that the casing 20 can be easily pulled away and disengaged from the housing 10.

Figure 4:
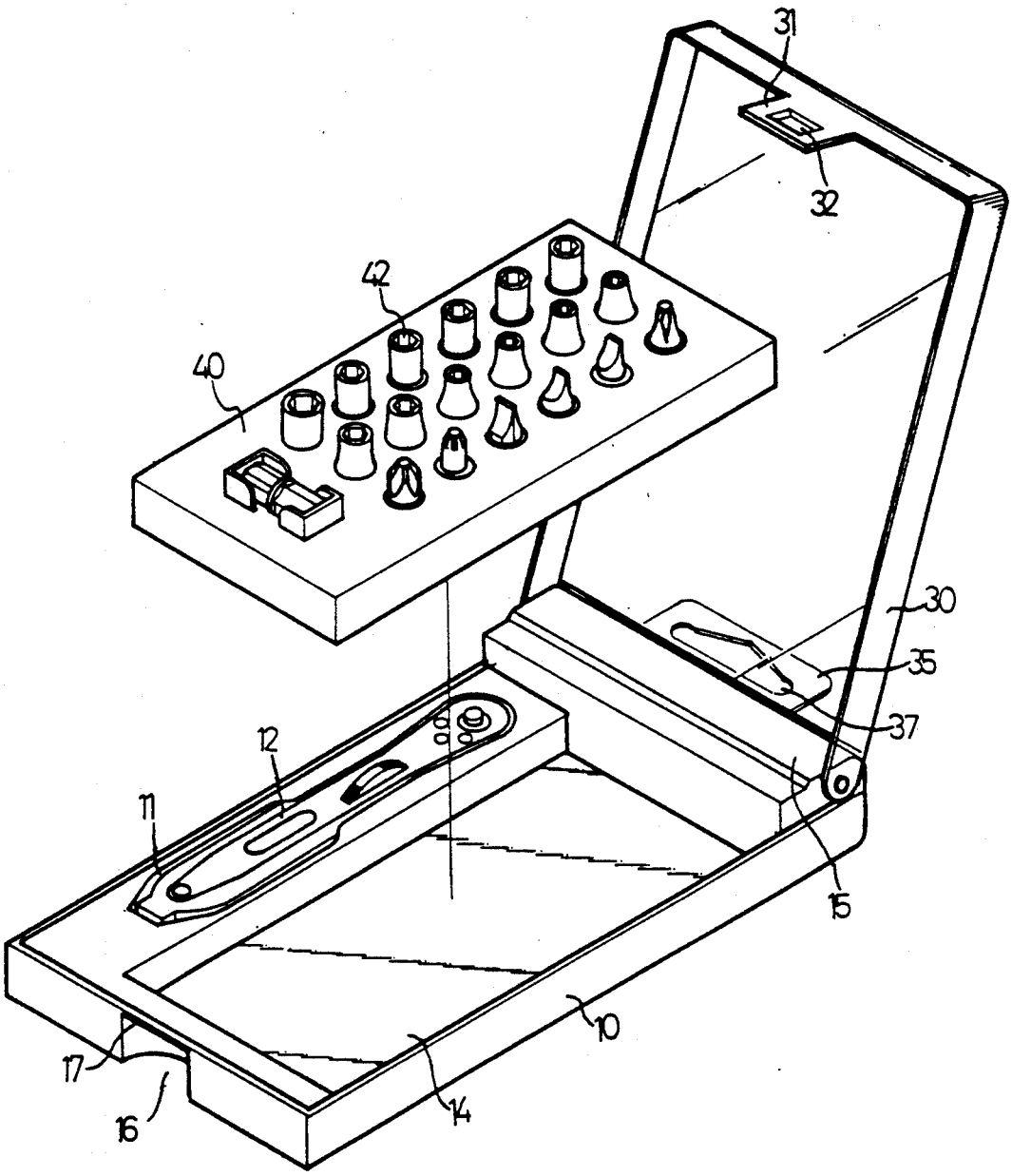

Referring next to FIG. 4, another set of tools 42 can be received in a second casing 40 which has a same size as that of the casing 20 and which is engageable within the chamber 14 of the housing 10. Similarly, a plurality sets of tools can be disposed and stored within a plurality of casings respectively. When one particular set of tools is required to be carried out for working purposes, the casing, on which the required set of tools is disposed, is selected and is disposed within the tool box so that only the tools of required sizes and of required shapes are carried.

Accordingly, a number sets of tools can be changeably disposed within the tool box in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising a housing having a cavity formed therein for receiving a wrench and having a chamber formed therein; a cover having a first end pivotally coupled to a first end of said housing and having a first engaging means formed on a second end thereof; a second engaging means formed in a second end of said housing and engageable with said first engaging means of said cover so that said cover can be maintained in a closed position; and at least two casings each engageable within said chamber of said housing and each having a plurality of holes formed therein, one set of tools being received in each of said casings, either of said casings, on which one set of tools of required size is disposed, can be selected and disposed in said chamber of said housing, each of said casings having a handle portion formed thereon so that said casing can be easily disengaged from said chamber of said housing.

* * * * *